US006799558B2

(12) United States Patent
Gmelin et al.

(10) Patent No.: US 6,799,558 B2
(45) Date of Patent: Oct. 5, 2004

(54) INTERNAL COMBUSTION ENGINE AND METHOD FOR OPERATING AN INTERNAL COMBUSTION ENGINE

(75) Inventors: Henry Gmelin, Stuttgart (DE); Eberhard Holder, Kusterdingen (DE); Roland Kemmler, Stuttgart (DE); Martin Matt, Bruchsal-Untergrombach (DE); Ralf Woerner, Weil der Stadt (DE); Wolf Zimmermann, Marbach (DE)

(73) Assignee: DaimlerChrysler AG, Stuttgart (DE)

( * ) Notice: Subject to any disclaimer, the term of this patent is extended or adjusted under 35 U.S.C. 154(b) by 68 days.

(21) Appl. No.: 10/307,522

(22) Filed: Dec. 2, 2002

(65) Prior Publication Data

US 2003/0127072 A1 Jul. 10, 2003

(30) Foreign Application Priority Data

Nov. 30, 2001 (DE) ..... 101 58 872

(51) Int. Cl.[7] ..... F02B 7/00

(52) U.S. Cl. ..... 123/431; 123/179.14; 123/491; 701/113

(58) Field of Search ..... 123/431, 491, 123/522, 523, 543, 544, 557, 179.7, 179.14, 537, 538, 456, 575, 3; 701/113

(56) References Cited

U.S. PATENT DOCUMENTS

| | | | | |
|---|---|---|---|---|
| 5,482,023 A | * | 1/1996 | Hunt et al. | 123/491 |
| 5,875,743 A | * | 3/1999 | Dickey | 123/25 C |
| 6,371,094 B1 | * | 4/2002 | Wagner | 123/576 |
| 6,508,236 B2 | * | 1/2003 | Amou et al. | 123/545 |
| 6,679,224 B2 | * | 1/2004 | Stanglmaier | 123/431 |

FOREIGN PATENT DOCUMENTS

| | | |
|---|---|---|
| DE | 42 14 949 C1 | 4/1993 |
| DE | 196 33 259 A1 | 2/1998 |

* cited by examiner

*Primary Examiner*—Hai Huynh
(74) *Attorney, Agent, or Firm*—Crowell & Moring LLP

(57) ABSTRACT

An internal combustion engine having one injection valve (3) per cylinder and at least one additional port injector (5) for injecting fuel into combustion air which is fed to the cylinders (2) in the intake tract (4). The port injector (5) havs two supply inlets (10, 11) which can be closed off. A control unit (8) determines the quantity of fuel which is to be delivered as a function of the operating state of the internal combustion engine (1). Separately provided starting fuel is delivered by the port injector (5) during the warm-up phase of the internal combustion engine.

10 Claims, 2 Drawing Sheets

INTERNAL COMBUSTION ENGINE AND METHOD FOR OPERATING AN INTERNAL COMBUSTION ENGINE

This application claims the priority of German Application No. 101 58 872.0-1 filed Nov. 30, 2001, the disclosure of which is expressly incorporated by reference herein.

BACKGROUND AND SUMMARY OF THE INVENTION

The invention relates to an internal combustion engine having an injection valve, and to a method for operating an internal combustion engine of this type.

In order to maintain the minimum possible exhaust emissions from an internal combustion engine, it is possible to influence the combustion performance of the fuel in the cylinders of the internal combustion engine by forming the optimum possible mix. Particularly during the warm-up phase of the internal combustion engine immediately after the engine has been started in the cold state, it is often impossible to achieve low levels of emissions. These problems can be avoided if starting fuel, which is more readily flammable than the fuel used for normal operation of the internal combustion engine, is provided separately.

German Patent DE 42 15 959 C1 discloses a fuel supply system of this type in which, during the warm-up phase, readily flammable gaseous fuel fractions are supplied from a storage tank. In this case, the starting-fuel fractions are metered into the intake line of the internal combustion engine as a function of operating parameters of the internal combustion engine, such as engine speed, coolant temperature or warm-up temperature.

German Patent DE 196 33 259 A1 proposes a fuel vaporizer for an internal combustion engine, which is additionally provided for individual injection into the cylinders and has a downstream fuel separator which separates low-volatility fuel constituents out of the fuel vapour, in order to prevent the fuel vapour from being condensed back into the lines which carry fuel vapour. However, the known measures are only intended for the warm-up phase of the internal combustion engine, requiring a relatively high structural outlay.

An object of the present invention is to provide an internal combustion engine and a method for operating the internal combustion engine having improvements in the exhaust emissions and in the operating performance of the internal combustion engine achieved over the entire operating range of the internal combustion engine.

According to the invention, for each cylinder of the internal combustion engine there is one injection valve and, in addition, there is at least one port injector at the intake tract of the internal combustion engine. The port injector has two supply inlets, which can be closed off by the control unit and having the first supply inlet connected to a device for preparing starting fuel and the second supply inlet connected to a fuel tank. Suitable injection valves are provided in particular induction port valves or direct injection valves. During the warm-up phase of the internal combustion engine, the port injector delivers starting fuel which is provided by a preparation module connected to the supply inlet of the port injector. In higher load ranges of the internal combustion engine, additional fuel is delivered by the port injector via the second supply inlet, so that the total quantity of fuel which is to undergo combustion can be metered proportionately via the injection valves and the port injector. Therefore, according to the invention, both the starting fuel and the fuel for normal operation, i.e. two different types of fuel, can be metered using one injector and therefore with a low structural outlay. The bi-fuel port injector with two supply inlets is preferably positioned downstream of the electronic throttle valve control device, as seen in the direction of flow in the intake tract, or, in V-engines or similar engines, such as W arrangements, at the junction of the different cylinder banks.

The total quantity of the fuel which is to undergo combustion in the cylinder is preferably metered proportionately by the injection valves and by the port injector. The control unit determine the quantitative proportions which are to be delivered by the port injector and the injection valve of the corresponding cylinders. The benefit results, in particular, when the internal combustion engine is operating in relatively high load ranges, in which a basic quantity of the total amount of fuel, which is to undergo combustion, is metered in via the port injector, and the quantity of fuel required for combustion is topped up by the sequentially actuated injection valves. Therefore, the injection valves can be designed for lower quantitative flow rates, with the result that more accurate metering of injection is possible in idling mode or at low engine speeds. Furthermore, smooth running of the engine and the control quality of injection can be improved. Moreover, the internal combustion engine has better cold-starting properties, since the smaller opening gaps of the injection valves make it possible to set an optimum form for the jet of fuel injected into the combustion chamber. The reduction in the Sauter diameter causes the fuel to evaporate more quickly, and, as a result, the mixture formation and the combustion are improved. The advantages of optimum control of the fuel injection with smaller delivery quantities from the injection valves are particularly clear in internal combustion engines whose injection valves are fed with fuel from a common pressure line (common rail injection).

During the warm-up phase, the internal combustion engine is preferably operated with a lean mixture so that a further contribution is made to reducing the exhaust emissions during a cold start. Furthermore, if the mix formed in the warm-up phase is lean, the exhaust gas is heated to a lesser extent, so that it is possible to dispense with a secondary air system which is required for warming up with a rich mix being formed. The manufacturing costs of the internal combustion engine can be reduced considerably by dispensing with the fitting of relatively large secondary air pumps and also device at the engine/cylinder head, such as switching valves, hoses, or secondary bores in the cylinder head.

The reduction in the untreated emissions may make it possible to do without catalytic converters arranged immediately adjacent to the internal combustion engine in order to comply with the statutory exhaust limits. It is sufficient for catalytic converters to be arranged in the region of the underbody of a vehicle which is driven by the internal combustion engine. In this area, the catalytic converters are subject to less ageing, because the temperatures are lower than in the vicinity of the engine and because the thermal load on the catalytic converters is lower.

Other objects, advantages and novel features of the present invention will become apparent from the following detailed description of the invention when considered in conjunction with the accompanying drawings.

BRIEF DESCRIPTION OF THE DRAWINGS

An exemplary embodiment of the invention is explained in more detail below with reference to the drawing, in which.

DETAILED DESCRIPTION OF THE DRAWINGS

Figure 1:
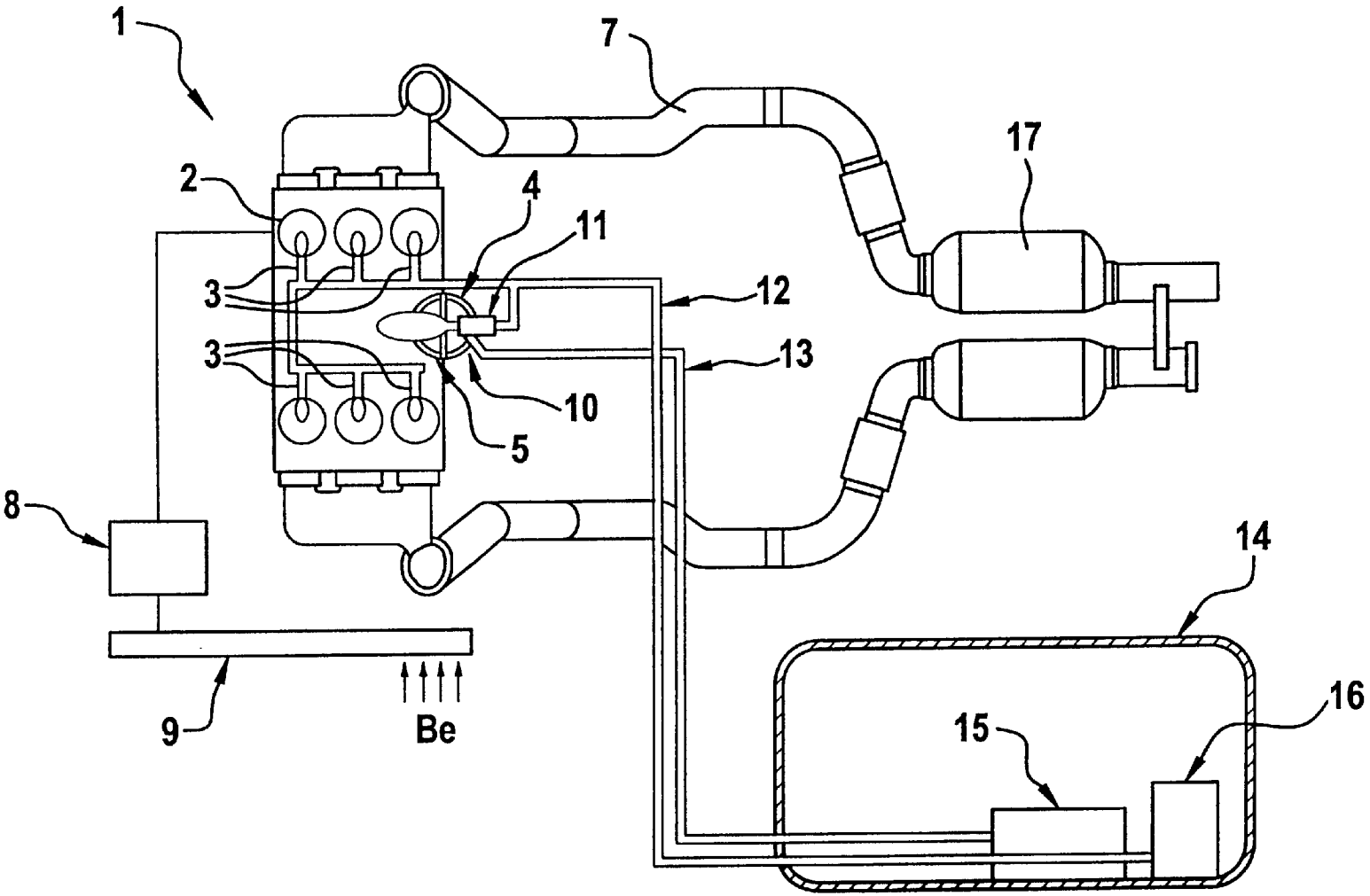
FIG. 1 shows a diagrammatic view of an internal combustion engine according to the invention.

FIG. 1 shows an internal combustion engine 1 with six cylinders 2, each of which is assigned an injection valve 3. The injection valves 3 are fed from a common fuel line 12, which is connected to a fuel tank 14 and specifically to a swirl pot 16 situated therein. The fuel can be provided under static pressure in the pressure line 12. The exhaust gases from the cylinders 2 are passed via an exhaust pipe 7 through a catalytic converter 17 and are released to the environment. In the present exemplary embodiment, the cylinders are combined in groups, each group of cylinders being assigned an exhaust pipe 7 and a corresponding catalytic converter 17.

The internal combustion engine 1 has a further fuel injector 5, which is provided in the intake tract 4 of the internal combustion engine. In the present exemplary embodiment, the port injector 5 is arranged in the common part of the intake line of all the cylinders 2. The port injector 5 has two supply inlets 10, 11, the first supply inlet 10 being connected via a fuel line 13 to a module 15 for preparation of starting fuel. The preparation module 15 is arranged in the fuel tank 14 in order to save space and uses the stock of fuel to prepare a sufficient quantity of the starting fuel for the next time the internal combustion engine is started up.

During the warm-up phase of the internal combustion engine, more readily flammable starting fuel is metered via the port injector 5, and the supply inlet 10 to the preparation module 15 is opened accordingly. The metering of the fuel and therefore the formation of the mix is adjusted by a control unit 8 as a function of the operating state of the internal combustion engine. The control unit is connected in a signal-transmitting manner both to the sequentially actuated injection valves 3 and to the port injector 5 in the intake tract 4. As soon as the warm-up phase of the internal combustion engine has ended, the preparation of fuel can be switched off and the supply inlet for the starting fuel can be closed. In the lower and middle load ranges, the fuel arriving for combustion is metered via the injection valves 3, which are actuated accordingly by the control unit 8. In higher load ranges, the control unit 8 also opens the second supply connection 11 of the port injector 5 and causes a basic quantity of the fuel which is to undergo combustion to be metered through the port injector 5. In this way, the basic quantity of the fuel which is to undergo combustion is supplied as early as with the combustion air, and a residual missing quantity of the total amount of fuel which is to be metered in is injected by the cylinder-specific injection.

Accordingly, the injection valves are designed for lower flow quantities which are sufficient for medium load ranges and for metering the residual amounts in higher load ranges. Extremely accurate control of the fuel metering can be achieved with smaller opening diameters and shorter opening times of the injection valves. The control unit is responsible for coordinating the proportions of the amounts of fuel which are to be delivered via port injection and direct injection in the total quantity of fuel which is to undergo combustion in the cylinder in question. The injection parameters for the entire operating range of the internal combustion engine are provided in a characteristic diagram memory 9 for the control unit to read out. The injection parameters are stored electronically as a function of operating parameters of the internal combustion engine 1.

The bi-fuel port injector 5 in the intake tract 4 is thus used both as a central injector for covering full load operation with fuel and to optimize the warm-up phase by supplying starting fuel. Therefore, the different fuels for the higher load ranges and for the warm-up phase can be injected while little space is required. In this way, firstly the levels of pollutant emissions during the warm-up phase are reduced. Secondly, in normal operation and in particular in higher load ranges of the internal combustion engine, there is an improvement in the power delivered and, in particular on account of the improved control quality with smaller injection cross sections of the injection valves, the levels of pollutant emissions are reduced.

The catalytic converters 17 are preferably arranged in the region of the underbody of the vehicle which is driven by the engine, where the exhaust gas is at a cooler temperature than the temperature at which it leaves the internal combustion engine, on account of the position. Furthermore the catalytic converter is subjected to a lower thermal load. The catalytic converters used are preferably active hydrocarbons, or adsorbers in the underbody region or nitrogen oxide storage catalytic converters. During the warm-up phase, the exhaust-gas temperature is also reduced by operation with the formation of a lean mix. The lean-running with starting fuel in the event of a cold start minimizes the emissions of exhaust gas during the warm-up phase considerably, so that it may be possible to dispense with a secondary air system.

Figure 2:
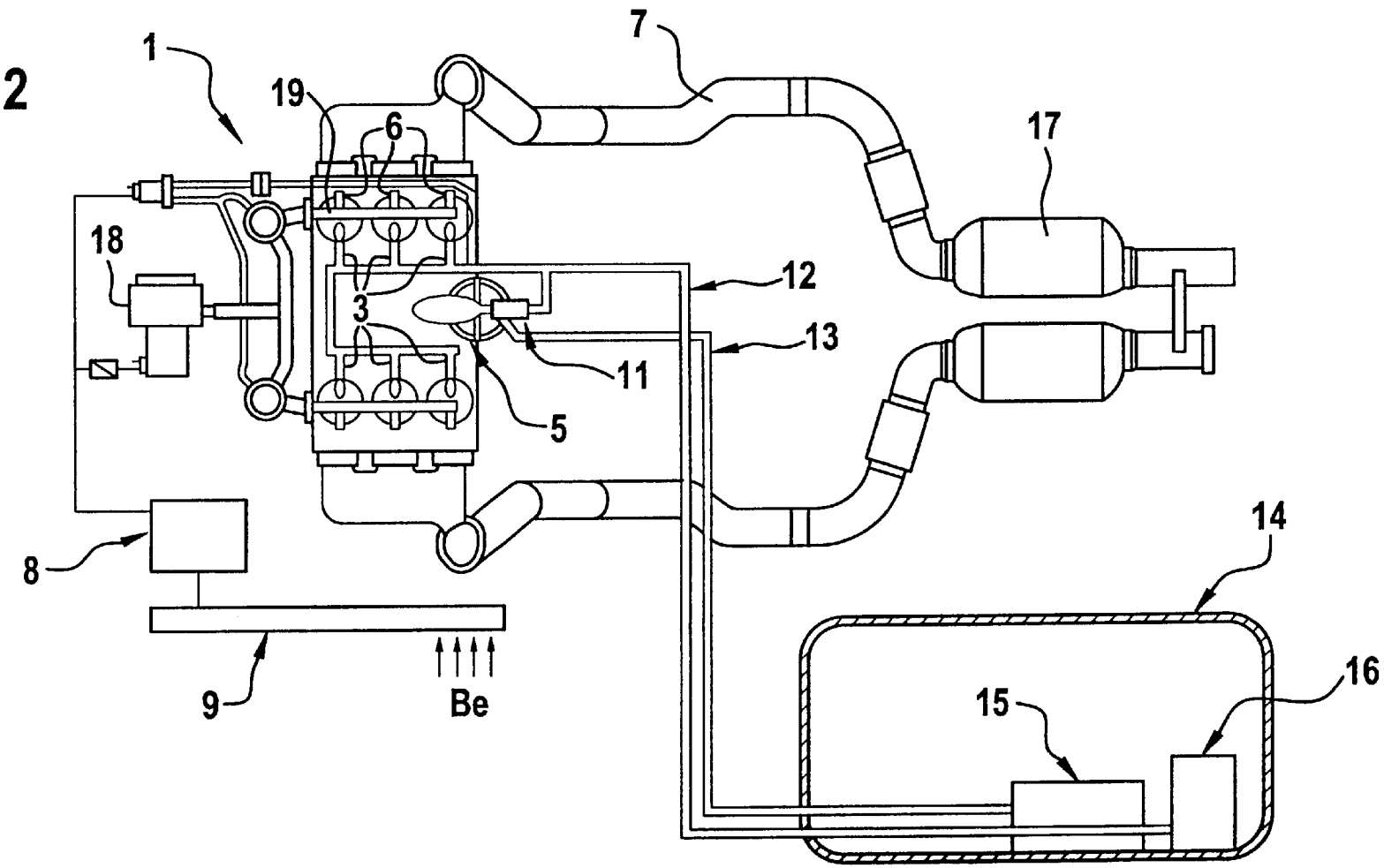
FIG. 2 shows a diagrammatic view of an internal combustion engine with a secondary air system according to the invention.

As has already been described in FIG. 1, the internal combustion engine 1 illustrated in FIG. 2 is equipped with one injection valve 3 per cylinder and an additional port injector 5 in the induction port of the internal combustion engine 1. This variant embodiment comprises a secondary air system, which is likewise activated by the control unit 8. To lower the exhaust emissions in the warm-up phase, a secondary air pump 18 provides air which is to be blown into the exhaust gas. The secondary air is passed from the air pump 18 via secondary air ports 19 in the cylinder heads to the blowing ports 6 which open out into the exhaust pipe 7 downstream of the exhaust valves of the respective cylinders.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An internal combustion engine having a plurality of cylinders, said engine comprising:

a plurality of injection valves with one injection valve provided for each one of said plurality of cylinders;

at least one port injector arranged to inject fuel into combustion air fed to said plurality of cylinders in an intake tract of said engine;

a control unit for controlling quantities of fuel released wherein said quantities are controlled as a function of an operating state of said internal combustion engine, said control unit providing signals to each of said injection valves and to said port injector in the intake tract wherein said port injector includes two supply inlet controlled to be closed off by signals output from said control unit wherein a first one of said two supply inlet is connected to a starting fuel preparing device, and wherein a second one of said two supply inlet is connected to a fuel tanks.

2. The internal combustion engine according to claim 1, wherein the starting fuel preparation device receives fuel from the fuel tank.

3. The internal combustion engine according to claim 1, the starting fuel preparation device is integrated in the fuel tank.

4. The internal combustion engine according to one of claim 1, wherein the injection valves of the cylinders are fed with fuel from a common pressure line.

5. A method for operating an internal combustion engine, comprising the steps of:

metering a quanitity of fuel to undergo combustion by direct injection by means of injection valves assigned to respective cylinders, and by injection into combustion air flowing to the cylinders by means of at least one port injector arranged in a intake tract wherein a first portion of the quantity of fuel which is to be delivered by said injection valves and a second portion of the quantity of fuel to be delivered by the port injector are each determined by a control unit as a function of an operating state of the internal combustion engine and;

deliver starting fuel by means of said port injector separately during a warm-up phase of the internal combustion engine.

6. The method according to claim 5, wherein the quantity of fuel which is to undergo combustion in the cylinder is metered proportionately by cylinder-individual injection and by port injection into the intake tract.

7. The method according to claim 5, wherein the internal combustion engine is operated with a lean mix during the warm-up phase.

8. The method according to claim 5, wherein at high operating loads of the internal combustion engine, a proportionate basic quantity of the fuel which is to undergo combustion is metered by port injection and a residual quantity is injected directly into the respective cylinder.

9. The method according to claim 5, wherein fuel is fed from a common pressure line to said injection valves.

10. The method according to claim 5, wherein delivery of separately provided starting fuel is fed from a starting fuel preparation device.

* * * * *